US008690553B2

(12) United States Patent
Peters

(10) Patent No.: US 8,690,553 B2
(45) Date of Patent: Apr. 8, 2014

(54) SERVICE PACK TANDEM PUMP

(75) Inventor: Mark E. Peters, New London, WI (US)

(73) Assignee: Illinois Tool Works Inc., Glenview, IL (US)

( * ) Notice: Subject to any disclaimer, the term of this patent is extended or adjusted under 35 U.S.C. 154(b) by 892 days.

(21) Appl. No.: 12/358,147

(22) Filed: Jan. 22, 2009

(65) Prior Publication Data

US 2009/0193800 A1 Aug. 6, 2009

Related U.S. Application Data

(60) Provisional application No. 61/026,127, filed on Feb. 4, 2008.

(51) Int. Cl.
*F04B 23/04* (2006.01)

(52) U.S. Cl.
USPC ..... 417/429

(58) Field of Classification Search
USPC ..... 417/429
See application file for complete search history.

(56) References Cited

U.S. PATENT DOCUMENTS

| | | | | |
|---|---|---|---|---|
| 3,156,313 | A | 11/1964 | Peterson | |
| 3,319,739 | A | 5/1967 | Mores | |
| 3,587,237 | A | 6/1971 | Pierrat | |
| 3,891,354 | A | 6/1975 | Bosch | |
| 4,029,439 | A | 6/1977 | Adams | |
| 4,189,021 | A * | 2/1980 | Scheuerpflug et al. | 180/69.6 |
| 4,293,284 | A | 10/1981 | Carlson et al. | |
| 4,359,137 | A | 11/1982 | Merz et al. | |
| 5,421,705 | A | 6/1995 | Benckert | |
| 5,564,522 | A | 10/1996 | Markin et al. | |
| 6,478,714 | B2 | 11/2002 | Onnen et al. | |
| 6,556,065 | B1 * | 4/2003 | Keeth et al. | 327/536 |
| 6,568,493 | B2 | 5/2003 | Parkert et al. | |
| 2003/0075139 | A1 * | 4/2003 | Shoemaker | 123/198 R |

(Continued)

FOREIGN PATENT DOCUMENTS

| | | |
|---|---|---|
| AU | 468888 | 12/1975 |
| AU | 4447185 | 1/1987 |

(Continued)

OTHER PUBLICATIONS

U.S. Appl. No. 11/943,564, filed Nov. 20, 2007, Beeson et al.

(Continued)

*Primary Examiner* — Anh Mai
*Assistant Examiner* — Hana Featherly
(74) *Attorney, Agent, or Firm* — Fletcher Yoder P.C.

(57) ABSTRACT

In certain embodiments, a service pack includes an engine, a tandem pump system coupled to the engine, and a controller. The tandem pump system may include a first pump and a second pump in tandem with one another. The controller may be configured to enable the first pump at a first load condition associated with the engine, the second pump at a second load condition associated with the engine, and both the first and second pumps at a third load condition associated with the engine. The load conditions may correspond to engine loads, hydraulic loads, or other loads associated with the engine. For example, at a low hydraulic pressure, the controller may selectively operate both the first and second pumps, whereas the controller may selectively operate only the first pump or the second pump at high and medium hydraulic pressures, respectively. In this manner, the system can provide suitable flow without overloading the engine.

23 Claims, 5 Drawing Sheets

(56) References Cited

U.S. PATENT DOCUMENTS

| | | | | |
|---|---|---|---|---|
| 2004/0139932 | A1* | 7/2004 | Palmer | 123/41.1 |
| 2004/0248307 | A1* | 12/2004 | Grof et al. | 436/56 |
| 2005/0133489 | A1 | 6/2005 | Gitter et al. | |
| 2006/0027547 | A1 | 2/2006 | Silvestro | |
| 2008/0122195 | A1 | 5/2008 | Beeson et al. | |
| 2008/0264920 | A1 | 10/2008 | Leisner et al. | |
| 2008/0264921 | A1 | 10/2008 | Kropp et al. | |
| 2008/0264922 | A1 | 10/2008 | Fosbinder | |

FOREIGN PATENT DOCUMENTS

| | | |
|---|---|---|
| DE | 202005000677 | 3/2005 |
| DE | 102004017087 | 11/2005 |
| EP | 0458050 | 11/1991 |
| EP | 0580248 | 1/1994 |
| EP | 1065386 | 1/2001 |
| EP | 1522693 | 4/2005 |
| FR | 2873364 | 1/2006 |
| GB | 959381 | 6/1964 |
| GB | 1290925 | 9/1972 |
| GB | FR2232692 | 1/1975 |
| JP | 6127118 | 12/1986 |
| JP | 61271118 | 12/1986 |
| JP | 06227309 | 8/1994 |
| WO | WO0112967 | 2/2001 |
| WO | WO 2006011836 A1 * | 2/2006 |
| WO | WO2007067178 | 6/2007 |
| WO | WO2008067252 | 6/2008 |

OTHER PUBLICATIONS

U.S. Appl. No. 12/040,568, filed Feb. 29, 2008, Beeson.
U.S. Appl. No. 12/358,119, filed Jan. 22, 2009, Peters.
U.S. Appl. No. 12/361,394, filed Jan. 28, 2009, Peotter et al.
Brochure entitled "HIPPO 2032E"; Mobile Hydraulic Equipment Co, LLC: www.multipower.us; 2 pages.
U.S. Appl. No. 12/040,328, filed Feb. 29, 2008, Beeson.

* cited by examiner

SERVICE PACK TANDEM PUMP

CROSS REFERENCE TO RELATED APPLICATION

This application claims priority to U.S. Provisional Patent Application No. 61/026,127, entitled "Service Pack Tandem Pump", filed on Feb. 4, 2008, which is herein incorporated by reference in its entirety.

BACKGROUND

The invention relates generally to hydraulic systems. More particularly, this invention relates to the delivery and control of fluid power to a service truck to operate equipment on or near the truck, for example, but not limited to, a crane with multiple functions.

Existing work vehicles often integrate auxiliary resources, such as electrical power, compressor air service, and/or hydraulic service, directly from the mechanical power of the main vehicle engine. Specifically, the main vehicle engine may drive a power take-off (PTO) shaft, which in turn drives the various integrated auxiliary resources. This is common in many applications where the auxiliary systems are provided as original equipment, either standard with the vehicle or as an option. The work vehicles also may include a clutch or other selective engagement mechanism to enable the selective engagement and disengagement of the integrated auxiliary resources.

Unfortunately, these integrated auxiliary resources rely on operation of the main vehicle engine. The main vehicle engine is typically a large engine, which is particularly noisy, significantly over powered for the integrated auxiliary resources, and fuel inefficient. For example, the main vehicle engine may be a spark ignition engine or a compression ignition engine (e.g., diesel engine) having six or more cylinders. The main vehicle engine may have over 200 horsepower, while the integrated auxiliary resources may only need about 20-40 horsepower. Unfortunately, an operator typically leaves the main vehicle engine idling for extended periods between actual use of the integrated auxiliary resources, simply to maintain the option of using the resources without troubling the operator to start and stop the main vehicle engine. Such operation reduces the overall life of the engine and drive train for vehicle transport needs.

Furthermore, the vehicle with integrated auxiliary resources does not control the power consumption, because the main vehicle engine has equal or more power than what is needed under all maximum power consumption circumstances (e.g., full hydraulic flow and pressure). Instead, the main vehicle engine typically runs at a normal condition without any change despite the various loads associated with the integrated auxiliary resources. At this normal condition, the main vehicle engine generally provides a great deal of wasted power.

BRIEF DESCRIPTION

Certain aspects commensurate in scope with the originally claimed invention are set forth below. It should be understood that these aspects are presented merely to provide the reader with a brief summary of certain forms the invention might take and that these aspects are not intended to limit the scope of the invention. Indeed, the invention may encompass a variety of aspects that may not be set forth below.

In certain embodiments, a service pack includes an engine, a tandem pump system coupled to the engine, and a controller.

The tandem pump system may include a first pump and a second pump in tandem with one another. The controller may be configured to enable the first pump at a first load condition associated with the engine, the second pump at a second load condition associated with the engine, and both the first and second pumps at a third load condition associated with the engine. The load conditions may correspond to engine loads, hydraulic loads, or other loads associated with the engine. For example, at a low hydraulic pressure, the controller may selectively operate both the first and second pumps, whereas the controller may selectively operate only the first pump or the second pump at high and medium hydraulic pressures, respectively. In this manner, the system can provide suitable flow without overloading the engine.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
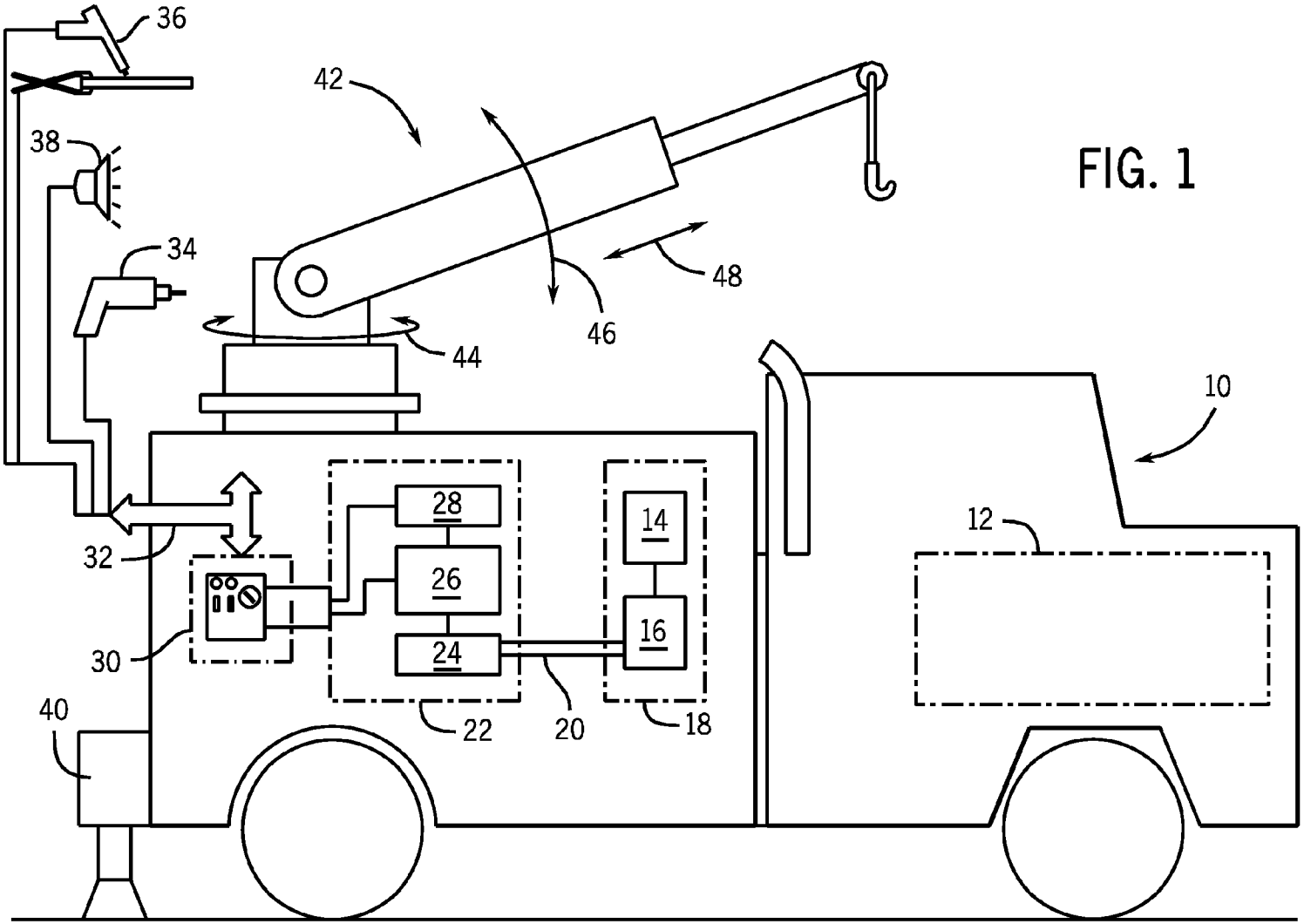
FIG. 1 is a diagram illustrating a work vehicle having first and second service pack modules with load sense in accordance with embodiments of the present technique.

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

As discussed below, certain embodiments may include control of a pump based on various loads associated with the engine driving the pump. In the present embodiments, the engine may include a spark ignition (SI) engine or a compression ignition (CI) engine other than the main vehicle engine. Thus, the engine may be substantially smaller in size, weight, and power output (e.g., horsepower) as compared to the main vehicle engine. For example, certain embodiments of the engine may provide 20-40 horsepower. Advantageously, the smaller engine provides greater fuel efficiency and costs less for various applications in addition to the clear advantages in reduced size, weight, and so forth.

Unfortunately, the smaller engine can become overloaded by one or more loads during operation. In certain embodiments, the engine may drive an electrical generator, a compressor, a hydraulic pump, or a combination thereof. Thus, the loads may include various electrical tools, lights, a welding torch, a cutting torch, and the like. The loads also may include an air tool, a pneumatic spray gun, and the like. Furthermore, the loads may include a hydraulic lift, a hydraulic crane, a hydraulic stabilizer, a hydraulic tool, and the like. Each of these loads has certain demands, which can overload the prime mover either alone or in certain combinations with one another.

As discussed below, the present embodiments provide a control scheme to tailor or generally match the loads (e.g., via use of a plurality of tandem pumps) on the engine to the available power of the engine. Although the disclosed embodiments refer to hydraulic loads, the techniques may be used with other loads such as electrical generators, air compressors, and so forth. Specifically, as discussed below, the disclosed control scheme limits the load created by a hydraulic pump system (e.g., a plurality of tandem pumps) in response to various sensor feedback, such as direct engine load feedback, hydraulic pressure feedback, engine RPMs, and so forth. The disclosed embodiments may be utilized with a variety of portable service packs, work vehicles with service packs or features, or other suitable applications. For example, the disclosed embodiments may be used in combination with any and all of the embodiments set forth in U.S. application Ser. No. 11/742,399, filed on Apr. 30, 2007, and entitled "ENGINE-DRIVEN AIR COMPRESSOR/GENERATOR LOAD PRIORITY CONTROL SYSTEM AND METHOD," which is hereby incorporated by reference in its entirety. Furthermore, the disclosed embodiments may be used in combination with any and all of the embodiments set forth in U.S. application Ser. No. 11/943,564, filed on Nov. 20, 2007, and entitled "AUXILIARY SERVICE PACK FOR A WORK VEHICLE," which is hereby incorporated by reference in its entirety.

Embodiments of the control scheme essentially tailor or match the loads on the engine with the power capability of the engine, thereby maximizing use of the engine for more efficient operation. Regarding hydraulic power, the disclosed embodiments are able to satisfy the needs of the operator by providing full pressure at less than full flow, and by providing full flow at less than full pressure (e.g., "power matching"). In order to provide this "power matching" feature, the control scheme functions to control the power consumption of the hydraulic system so as not to overpower the smaller engine.

Turning now to the drawings, FIG. 1 illustrates a work vehicle 10 including a main vehicle engine 12, first and second service pack modules 18 and 22, and various equipment in accordance with certain embodiments of the present technique. As discussed in further detail below, the first and second service pack modules 18 and 22 may provide various resources, such as electrical power, compressed air, and hydraulic power, with or without assistance from the main vehicle engine 12. Thus, in some embodiments, the operator can shut off the main vehicle engine to reduce noise, conserve fuel, and increase the life of the main vehicle engine 12, while the service pack modules 18 and 22 are self-powered or power one another. However, in some embodiments, the service pack modules 18 and 22 may utilize and/or provide some resources of the vehicle 10, e.g., use fuel from the vehicle, use hydraulic power from the vehicle, provide hydraulic power to the vehicle, and so forth. The illustrated work vehicle 10 is a work truck, yet other embodiments of the vehicle may include other types and configurations of vehicles.

The main vehicle engine 12 may include a spark ignition engine (e.g., gasoline fueled internal combustion engine) or a compression ignition engine (e.g., a diesel fueled engine), for example, an engine with 6, 8, 10, or 12 cylinders with over 200 horsepower. The vehicle engine 12 includes a number of support systems. For example, the vehicle engine 12 consumes fuel from a fuel reservoir, typically one or more liquid fuel tanks, which will be addressed later. Further, the vehicle engine 12 may include or couple to an engine cooling system, which may include a radiator, circulation pump, thermostat controlled valve, and a fan. The vehicle engine 12 also includes an electrical system, which may include an alternator or generator along with one or more system batteries, cable assemblies routing power to a fuse box or other distribution system, and so forth. The vehicle engine 12 also includes an oil lubrication system. Further, the vehicle engine 12 also couples to an exhaust system, which may include catalytic converters, mufflers, and associated conduits. Finally, the vehicle engine 12 may feature an air intake system, which may include filters, flow measurement devices, and associated conduits.

The service pack modules 18 and 22 may have a variety of resources, such as electrical power, compressed air, hydraulic power, and so forth. These service pack modules 18 and 22 also may operate alone or in combination with one another, e.g., dependent on one another. In the illustrated embodiment, the first service pack module 18 includes a service pack engine 14 and a tandem pump system 16 with load sense as discussed in detail below. In particular, the tandem pump system 16 may include a plurality of pumps arranged in series, in parallel, or both series and parallel, with respect to one another. These pumps may include a hydraulic pump, a water pump, a waste pump, a chemical pump, or any other fluid pump. As discussed below, the tandem pump system 16 may selectively engage one or more of these multiple pumps in response to feedback from a load sense, e.g., load conditions associated with the engine 14 and/or hydraulic load. The service pack engine 14 may include a spark ignition engine (e.g., gasoline fueled internal combustion engine) or a compression ignition engine (e.g., a diesel fueled engine), for example, an engine with 1-4 cylinders with approximately 10-80 horsepower. In some embodiments, the service pack engine 14 may have a small engine with approximately 10, 20, 30, 40, or 50 horsepower. Moreover, the service pack engine 14 may be undersized to improve fuel consumption, while the tandem pump system 16 with load sense can satisfy the needs of the operator by providing full pressure at less than full flow or by providing full flow at less than full pressure (e.g., "power matching"). The tandem pump system 16 may be configured to provide hydraulic power (e.g., pressurized hydraulic fluid) to one or more devices in the vehicle or elsewhere.

As illustrated in the embodiment of FIG. 1, the first and second service pack modules 18 and 22 are separate from one another and from vehicle engine 12. In other words, the first and second service pack modules 18 and 22 are stand-alone units relative to the vehicle engine 12, such that they do not rely on power from the vehicle engine 12. In some embodiments, the first and second service pack modules 18 and 22 may be combined as a single standalone unit, while still being separate from the vehicle engine 12. However, in the illustrated embodiment, the second service pack module 22 is driven by hydraulic fluid from the first service pack module 18, thereby making the second service pack module 22 dependent on the first service pack module 18 or another source of fluid (e.g., hydraulic fluid). Specifically, as illustrated in FIG. 1, the service pack engine 14 drives the tandem pump system 16, which in turn drives fluid motor 24 (e.g., hydraulic motor) located in second service pack module 22.

The fluid motor 24 (e.g., hydraulic motor) contained in second service pack module 22 may be coupled to air compressor 26 as well as generator 28. The air compressor 26 and the generator 28 may be driven directly, or may be belt, gear, or chain driven, by the fluid motor 24. The generator 28 may include a three-phase brushless type, capable of producing power for a wide range of applications. However, other generators may be employed, including single phase generators and generators capable of producing multiple power outputs. The air compressor 26 may also be of any suitable type, although a rotary screw air compressor is presently contemplated due to its superior output to size ratio. Other suitable air compressors might include reciprocating compressors, typically based upon one or more reciprocating pistons.

The first and/or second service pack modules 18 and 22 include conduits, wiring, tubing, and so forth for conveying the services/resources (e.g., electrical power, compressed air, and fluid/hydraulic power) generated by these modules to an access panel 30. The access panel 30 may be located on any portion of the vehicle 10, or on multiple locations in the vehicle, and may be covered by doors or other protective structures. In one embodiment, all of the services may be routed to a single/common access panel 30. The access panel 30 may include various control inputs, indicators, displays, electrical outputs, pneumatic outputs, and so forth. In an embodiment, a user input may include a knob or button configured for a mode of operation, an output level or type, etc. In the illustrated embodiment, the first and second service pack modules 18 and 22 supply electrical power, compressed air, and fluid power (e.g., hydraulic power) to a range of applications designated generally by arrows 32.

As depicted, air tool 34, torch 36, and light 38 are applications connected to the access panel 30 and, thus, the resources/services provided by the service pack modules 18 and 22. The various tools may connect with the access panel 30 via electrical cables, gas (e.g., air) conduits, fluid (e.g., hydraulic) lines, and so forth. The air tool 34 may include a pneumatically driven wrench, drill, spray gun, or other types of air-based tools, which receive compressed air from the access panel 30 and compressor 26 via a supply conduit (e.g., a flexible rubber hose). The torch 36 may utilize electrical power and compressed gas (e.g., air or inert shielding gas) depending on the particular type and configuration of the torch 36. For example, the torch 36 may include a welding torch, a cutting torch, a ground cable, and so forth. More specifically, the welding torch 36 may include a TIG (tungsten inert gas) torch or a MIG (metal inert gas) gun. The cutting torch 36 may include a plasma cutting torch and/or an induction heating circuit. Moreover, a welding wire feeder may receive electrical power from the access panel 30. Moreover, a hydraulically powered vehicle stabilizer 40 may be powered by the fluid system, e.g., tandem pump system 16, to stabilize the work vehicle 10 at a work site. In the illustration, a hydraulically powered crane 42 is also coupled to and powered by the tandem pump system 16. Again, the service pack modules 18 and 22 provide the desired resources/services to run various tools and equipment without requiring operation of the main vehicle engine 12.

As noted above, the disclosed service pack modules 18 and 22 may be designed to interface with any desired type of vehicle. Such vehicles may include cranes, manlifts, and so forth, which can be powered by the service pack modules 18 and/or 22. In the embodiment of FIG. 1, the crane 42 may be mounted within a bed of the vehicle 10, on a work platform of the vehicle 10, or on an upper support structure of the vehicle 10 as shown in FIG. 1. Moreover, such cranes may be mechanical, electrical or hydraulically powered. In the illustrated embodiment, the crane 42 can be powered by the service pack modules 18 and/or 22 without relying on the vehicle engine 12. That is, once the vehicle is positioned at the work site, the vehicle engine 12 may be stopped and the service pack engine 14 may be started for crane operation and use of auxiliary services. In the embodiment illustrated in FIG. 1, the crane 42 is mounted on a rotating support structure, and hydraulically powered such that it may be rotated, raised and lowered, and extended (as indicated by arrows 44, 46 and 48, respectively) by pressurized hydraulic fluid provided by the service pack output 32.

The vehicle 10 and/or the service pack modules 18 and 22 may include a variety of protective circuits for the electrical power, e.g., fuses, circuit breakers, and so forth, as well as valving for the fluid (e.g., hydraulic) and air service. For the supply of electrical power, certain types of power may be conditioned (e.g., smoothed, filtered, etc.), and 12 volt power output may be provided by rectification, filtering and regulating of AC output. Valving for fluid (e.g., hydraulic) power output may include by way example, pressure relief valves, check valves, shut-off valves, as well as directional control valving. Moreover, the tandem pump system 16 may draw fluid from and return fluid to a fluid reservoir, which may include an appropriate vent for the exchange of air during use with the interior volume of the reservoir, as well as a strainer or filter for the fluid. Similarly, the air compressor 26 may draw air from the environment through an air filter.

The first and second service pack modules 18 and 22 may be physically positioned at any suitable location in the vehicle 10. In a presently contemplated embodiment, for example, the service pack modules 18 and 22 may be mounted on, beneath or beside the vehicle bed or work platform rear of the vehicle cab. In many such vehicles, for example, the vehicle chassis may provide convenient mechanical support for the engine and certain of the other components of the service pack modules 18 and 22. For example, steel tubing, rails or other support structures extending between front and rear axles of the vehicle may serve as a support for the service pack modules 18 and 22 and, specifically, the components self-contained in those modules. Depending upon the system components selected and the placement of the service pack modules 18 and 22, reservoirs may be provided for storing fluid (e.g., hydraulic fluid) and pressurized air as noted above. However, the fluid reservoir may be placed at various locations or even integrated into the service pack modules 18 and/or 22. Likewise, depending upon the air compressor selected, no reservoir may be used for compressed air. Specifically, if the air compressor 26 includes a non-reciprocating or rotary type compressor, then the system may be tankless with regard to the compressed air.

In use, the service pack modules 18 and 22 provide various resources/services (e.g., electrical power, compressed air, fluid/hydraulic power, etc.) for the on-site applications completely independent of vehicle engine 12. For example, the service pack engine 14 generally may not be powered during transit of the vehicle from one service location to another, or from a service garage or facility to a service site. Once located at the service site, the vehicle 10 may be parked at a convenient location, and the main vehicle engine 12 may be shut down. The service pack engine 14 may then be powered to provide auxiliary service from one or more of the service systems described above. Where desired, clutches, gears, or other mechanical engagement devices may be provided for engagement and disengagement of one or more of the generator 28, the tandem pump system 16, and the air compressor 26, depending upon which of these service are desired. Moreover, as in conventional vehicles, where stabilization of the vehicle or any of the systems is require, the vehicle may include outriggers, stabilizers, and so forth which may be deployed after parking the vehicle and prior to operation of the service pack modules. The disclosed embodiments thus allow for a service to be provided in several different manners and by several different systems without the need to operate the main vehicle engine 12 at a service site.

Figure 2:
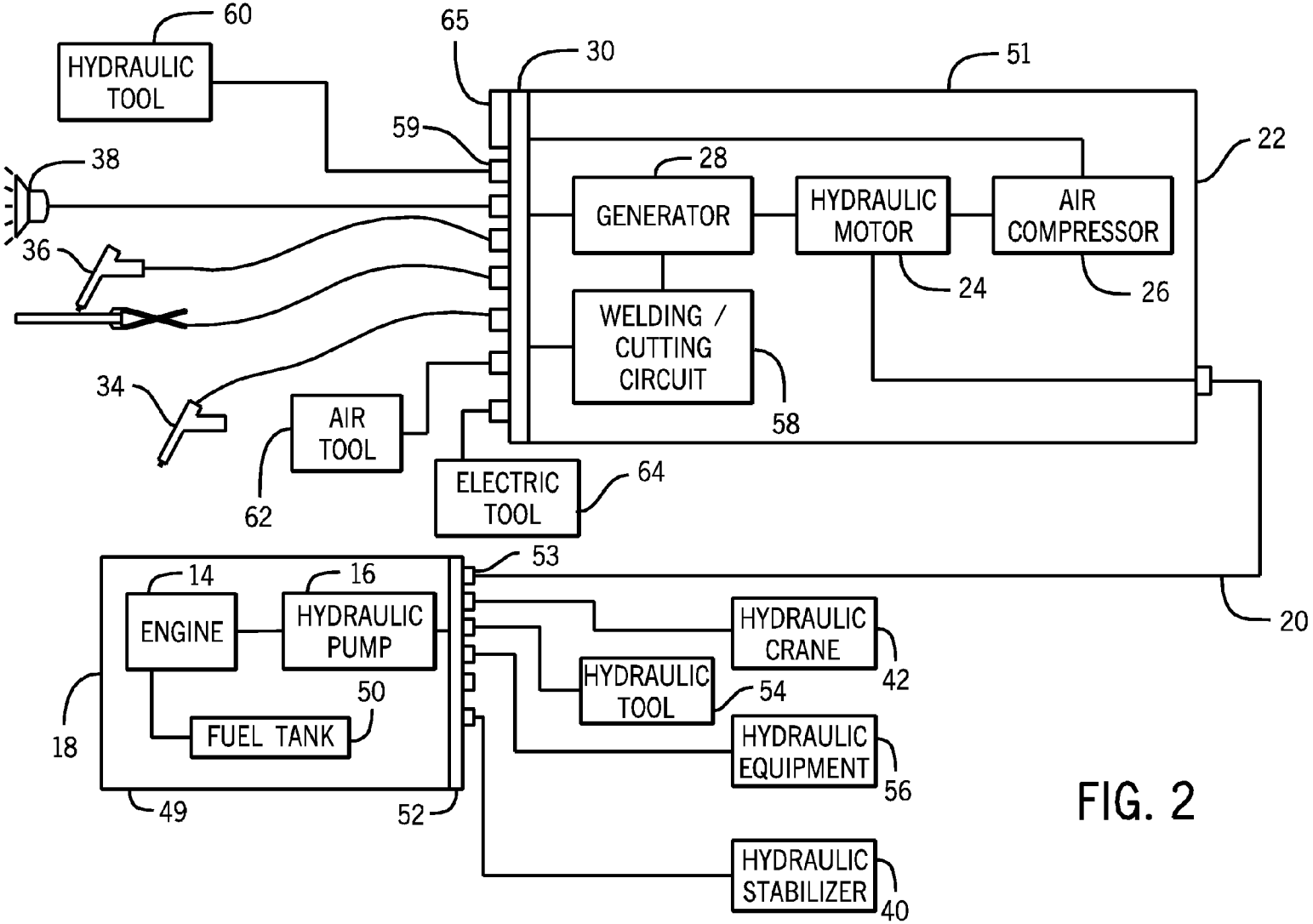
FIG. 2 is diagram illustrating first and second service pack modules in hydraulic communication with one another in accordance with embodiments of the present technique.

Several different arrangements are envisaged for the components of the first service pack module 18 and the second service pack module 22. FIG. 2 illustrates an embodiment of the first and second service pack modules 18 and 22, wherein the first service pack module 18 includes the service pack engine 14, the tandem pump system 16, and a fuel tank 50, and wherein the second service pack module 22 includes the fluid motor 24 (e.g., hydraulic motor), the air compressor 26, and the generator 28. As discussed below, the components of each service pack modules 18 and 22 are self-contained in respective enclosures 49 and 51, such that the modules 18 and 22 are independent and distinct from one another. In other words, the enclosure 49 of the module 18 self contains the engine 14, the tandem pump system 16, and the fuel tank 50 independent of both the module 22 and various components of the vehicle 10. Similarly, the enclosure 51 of the module 22 self contains the hydraulic motor 24, the air compressor 26, and the generator 28 independent of both the module 18 and various components of the vehicle 10. Again, in alternate embodiments, a single unit may include the components of both service pack modules 18 and 22.

The service pack modules 18 and 22 may be used independently or in combination with one another. For example, the first service pack module 18 may be used to provide fluid (e.g., hydraulic) power for any type of fluid driven (e.g., hydraulically driven) system, which may or may not include the second service pack module 22. In certain embodiments, the first service pack module 18 may be described as dependent only on a source of fuel, such as gasoline or diesel fuel, to operate the engine 14 and provide the hydraulic power. By further example, the second service pack module 22 may be hydraulically driven by any suitable source of hydraulic power, which may or may not include the tandem pump system 16 of the first service pack module 18. Thus, in certain embodiments, the second service pack module 22 may be described as hydraulically dependent on some source of hydraulic power, or more specifically, only hydraulic power dependence. However, some embodiments may combine the components of these two service pack modules 18 and 22 into a single unit.

Turning now to the details of FIG. 2, the first service pack module 18 includes a first service access panel 52, which includes fluid couplings 53 to output fluid (e.g., hydraulic fluid) from the tandem pump system 16 to various external devices. In the illustrated embodiment, the fluid couplings 53 couple to the second service pack module 22, the hydraulic crane 42, a hydraulic tool 54, hydraulic equipment 56, and the hydraulic stabilizer 40. For example, the second service pack module 22 is connected to the first service pack module 18 via fluid tubing 20 (e.g., hydraulic tubing) connected to one of the couplings 53.

As further illustrated in FIG. 2, the second service pack module 22 includes the fluid motor 24 (e.g., hydraulic motor) coupled to the air compressor 26 and generator 28, which is connected to the welding/cutting circuit 58. The circuit 58 may include one or more circuits configured to provide power, functions, and control for welding, cutting, wire feeding, gas supply, and so forth. The generator 28 may provide electrical power to the welding circuit 58 to operate various welding devices, such as those discussed above. The second service pack module 22 also includes a service pack access panel (e.g., 30), which includes couplings 59 (e.g., electrical, air, and optionally hydraulic connectors) for various external devices. For example, the service pack module 22 may or may not provide fluid couplings 59 (e.g., hydraulic couplings) as a pass through from the fluid received into the system. Connections to access panel 30 may provide service to several tools, including hydraulic tool 60, air tool 62, electric tool 64, air tool (e.g., wrench) 34, torch 36, and light 38. In addition, the various external devices include electrical cables, air hoses, fluid tubing, and so forth, as illustrated by the lines extending between the devices and their respective couplings 59 on the panel 30. The access panel 30 also may include one or more controls 65 for the various services/resources, e.g., electrical power, compressed air, hydraulics, etc. As discussed below, these controls 65 may include input controls (e.g., switches, selectors, keypads, etc.) and output displays, gauges, and the like.

As appreciated, the generator 28 and/or circuit 58 may be configured to provide AC power, DC power, or both, for various applications. Moreover, the circuit 58 may function to provide constant current or constant voltage regulated power suitable for a welding or cutting application. Thus, the torch 36 may be a welding torch 36, such as a MIG welding torch, a TIG welding torch, and so forth. The torch 36 also may be a cutting torch, such as a plasma cutting torch. The generator 28 and/or circuit 58 also may provide a variety of output voltages and currents suitable for different applications. For example, a 12 volt DC output of the module 22 may also serve to maintain the vehicle battery charge, and to power any ancillary loads that the operator may need during work (e.g., cab lights, hydraulic system controls, etc.).

Figure 3:
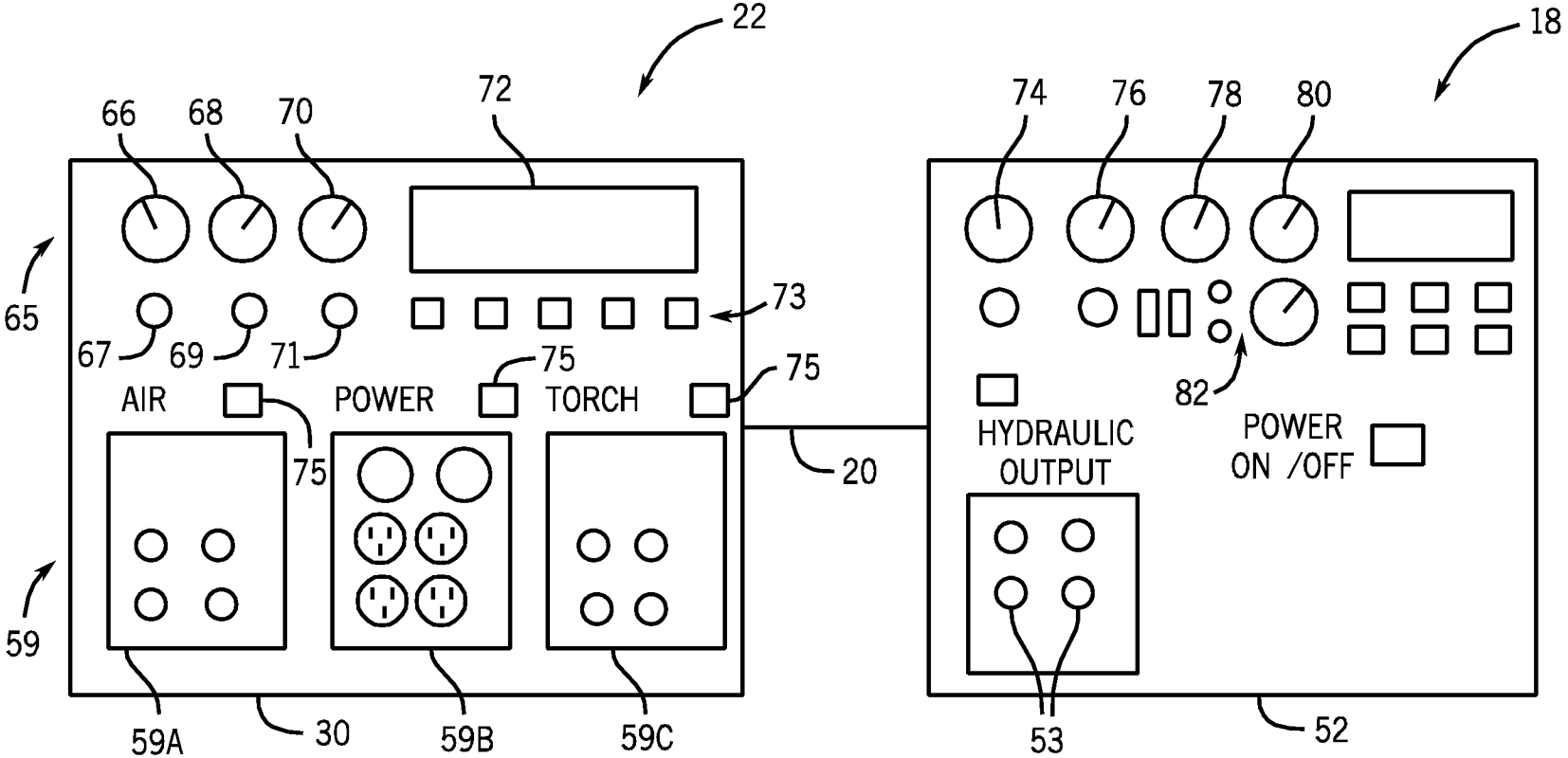
FIG. 3 is a diagram illustrating first and second control panels of the respective first and service pack modules as illustrated in FIG. 2, in accordance with embodiments of the present technique.

FIG. 3 illustrates an embodiment of the access panels 30 and 52 of the respective first and second service pack modules 18 and 22, as shown in FIGS. 1 and 2. In the illustrated embodiment, the access panel 30 of the module 22 includes the various couplings 59 and controls 65 shown in FIG. 2. Specifically, the couplings include a set of air couplings 59A, a set of electrical power couplings 59B, and a set of torch couplings 59C. The controls 65 include a voltage gauge 66 and associated voltage control knob 67, a current gauge 68 and associated current control knob 69, an air pressure gauge 70 and associated pressure control knob 71, and a display screen 72 (e.g., liquid crystal display) and associated input keys 73. The controls 65 also may include on/off switches or buttons 75 for each of the couplings 59, such that an operator can turn on and off the electrical power, the compressed air, and/or the fluid power (e.g., hydraulic power) linked to the couplings 59A, 59B, and 59C. Optionally, the access panel 30 may include various fluid couplings (e.g., hydraulic couplings), gauges, and controls in an embodiment that routes at least some of the fluid from the first module 18 through the second module 22 to various external hydraulic devices. Furthermore, the access panel 30 may be used as a central control panel for all resources/services provided by both modules 18 and 22 when these modules 18 and 22 are used in combination with one another.

In the illustrated embodiment, the access panel 52 may include several fluid (e.g., hydraulic) output couplings 53 as well as hydraulic and power controls to monitor and configure settings for service pack engine 14 and tandem pump system 16. The access panel 52 may also permit, for example, starting and stopping of the service pack engine 14 by a keyed ignition or starter button. The access panel 52 may also include a stop, disconnect, or disable switch that allows the operator to prevent starting of the service pack engine 14, such as during transport. The access panel 52 may also include fluid (e.g., hydraulic) pressure gauge 74, engine RPM gauge 76, engine fuel gauge 78, engine temperature gauge 80, and various inputs and outputs as generally depicted by numeral 82.

Figure 4:
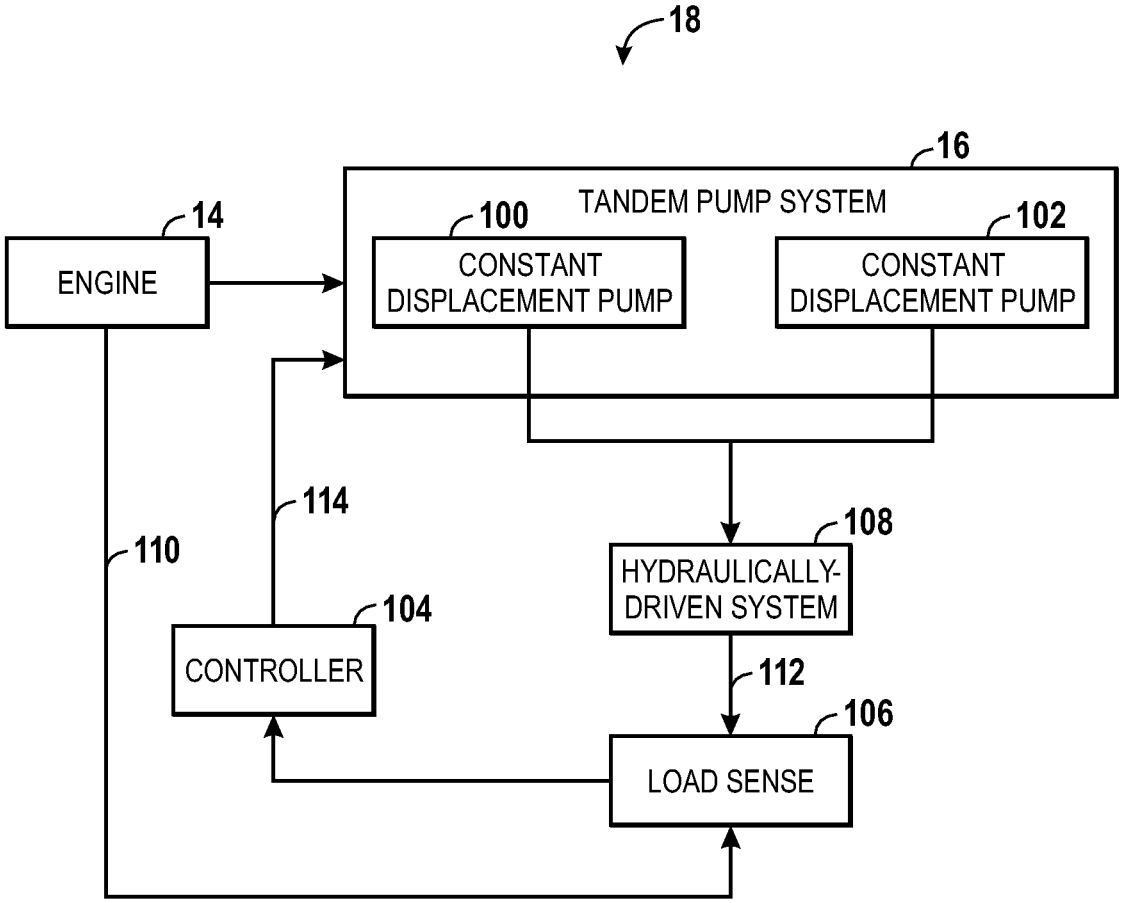
FIG. 4 is a diagram illustrating a system for controlling power of an engine by selectively driving one or more of a plurality of tandem pumps based on load sense in accordance with certain embodiments.

FIG. 4 is a diagram illustrating a system for controlling power of an engine 14 by selectively driving one or more of a plurality of tandem pumps 100 and/or 102 of the tandem pump system 16 in accordance with certain embodiments. As discussed above, the tandem pump system 16 may include any number of pumps, e.g., 2, 3, 4, 5, 6, 7, 8, 9, 10, or more, arranged in a parallel flow configuration, a series flow configuration, or a combination of parallel and series flow. In other words, the term tandem may refer to any arrangement of pumps that work together to produce a desired flow rate and/or pressure. These pumps, e.g., 100 and 102, may include constant displacement pumps, variable displacement pumps, or any other suitable pump type. However, the illustrated system 16 includes two constant displacement pumps 100 and 102 in a parallel arrangement for simplicity in the present discussion. In the illustrated embodiment, the system includes the engine 14, the tandem pump system 16, a controller 104, a load sense 106, and a hydraulically driven system 108.

The illustrated load sense 106 is configured to sense various load conditions on the engine 14, e.g., direct engine loads and/or loads associated with the hydraulically-driven system 108. In the illustrated embodiment, the illustrated controller 104 is configured to sense (via load sense 106) various load conditions 110 on the service pack engine 14, e.g., throttle/actuator position, fuel flow, engine torque, power output, RPM, exhaust temperature, and so forth. For example, in one specific embodiment, the load sense 106 monitors the throttle or actuator position on a carburetor or fuel injection system, thereby tracking the amount of fuel injected into the engine 14. The amount of fuel injection may be directly correlated to the engine load. For example, greater fuel injection may correlate with greater engine load, whereas lesser fuel injection may correlate with lesser engine load. The illustrated controller 104 is also configured to sense (via load sense 106) various load conditions 112 on the hydraulically driven system 108, e.g., hydraulic pressure, hydraulic flow rate, torque, power, and so forth.

As indicated by arrow 114, the controller 104 is configured to control the tandem pump system 16 in response to the load conditions 110 and/or 112 received from the load sense 106. If the controller 104 identifies a possible overload condition via the load sense 106, then the controller 104 is configured to control the tandem pump system 16 to reduce the hydraulic-based load on the system, thereby eliminating the possible overload condition. However, the controller 104 also may monitor under load conditions (e.g., wasted power), and reduce speed of the engine 14, increase the hydraulic-based load on the system, and so forth. As discussed below, the controller 104 is able to adjust the hydraulic-based load on the system by engaging or disengaging one or more pumps (e.g., pumps 100 or 102) in the tandem configuration.

In the illustrated embodiment, the controller 104 is configured to trigger or cause selective engagement and disengagement of the constant displacement pumps 100 and 102 to vary the fluid flow and pressure and, thus, alter the load on the engine 14. Specifically, the controller 104 may actuate the constant displacement pump 100 to provide a first constant displacement flow, the controller 104 may actuate the constant displacement pump 102 to provide a second constant displacement flow, and the controller 104 may actuate the constant displacement pumps 100 and 102 to provide a third constant displacement flow equal to the combination of the first and second constant displacement flows. In the illustrated embodiment, the first and second pumps 100 and 102 may have equal or different displacements from one another, thus the first and second constant displacement flows may be equal or different from one another. As a result, the controller 104 in combination with the tandem pump system 16 may vary the hydraulic-based load on the engine 14 to prevent or eliminate an overload condition of the engine 14. In some embodiments, the first and second pumps 100 and 102 may include variable displacement pumps, such that the controller 104 can vary the output of each pump alone or in combination with one another. Thus, the tandem pump system 16 may provide a broad range of hydraulic output via selective engagement and disengagement of pumps 100 and 102, as well as variable displacement provided by each pump 100 and 102. Again, the controller 104 is responsive to the load sense 106 to reduce the possibility of overloading the engine 14, while providing full pressure at less than full flow or by providing full flow at less than full pressure.

The illustrated controller 104 is configured to respond to the engine load conditions 110 in the system via the load sense 106. Specifically, the load sense 106 enables the controller 104 to monitor the load conditions 110 on the engine 14 as a feedback step to reduce or eliminate the possibility of overloading the engine 14. If the load sense 106 identifies a low exhaust temperature, a low fuel injection flow rate, or other load condition 110 indicative of a low engine load (e.g., wasted engine power), then the controller 104 may selectively engage or control the system 16 to utilize both of the constant displacement pumps 100 and 102. If the load sense 106 identifies a medium exhaust temperature, a medium fuel injection flow rate, or other load condition 110 indicative of a medium engine load, then the controller 104 may selectively engage or control the system 16 to utilize only the constant displacement pump 102 (e.g., larger than the pump 100). If the load sense 106 identifies a high exhaust temperature, a high fuel injection flow rate, or other load condition 110 indicative of a high engine load (e.g., insufficient engine power), then the controller 104 may selectively engage or control the system 16 to utilize only the constant displacement pump 100 (e.g., smaller than the pump 102). As a result, the control scheme enables selective control of the pumps 100 and 102 alone or in combination with one another to provide discrete steps in hydraulic flow and, thus, load on the engine 14, such that the engine 14 is not overloaded beyond its limits. As discussed above, this is particularly important due to the output limits of small engines 14.

Similarly, the illustrated controller 104 is configured to respond to the hydraulic pressure (e.g., load conditions 112) in the system via the load sense 106. Specifically, the load sense 106 enables the controller 104 to monitor the hydraulic pressure in the hydraulically-driven system 108 as a way to monitor the load on the engine 14. If the load sense 106 identifies a low hydraulic pressure, then the controller 104 may selectively engage or control the system 16 to utilize both of the constant displacement pumps 100 and 102. If the load sense 106 identifies a medium hydraulic pressure, then the controller 104 may selectively engage or control the system 16 to utilize only the constant displacement pump 102 (e.g., larger than the pump 100). If the load sense 106 identifies a high hydraulic pressure, then the controller 104 may selectively engage or control the system 16 to utilize only the constant displacement pump 100 (e.g., smaller than the pump 102). As a result, the control scheme enables selective control of the pumps 100 and 102 alone or in combination with one another to provide discrete steps in hydraulic flow and, thus, load on the engine 14, such that the engine 14 is not overloaded beyond its limits. As discussed above, this is particularly important due to the output limits of small engines 14.

Figure 5:
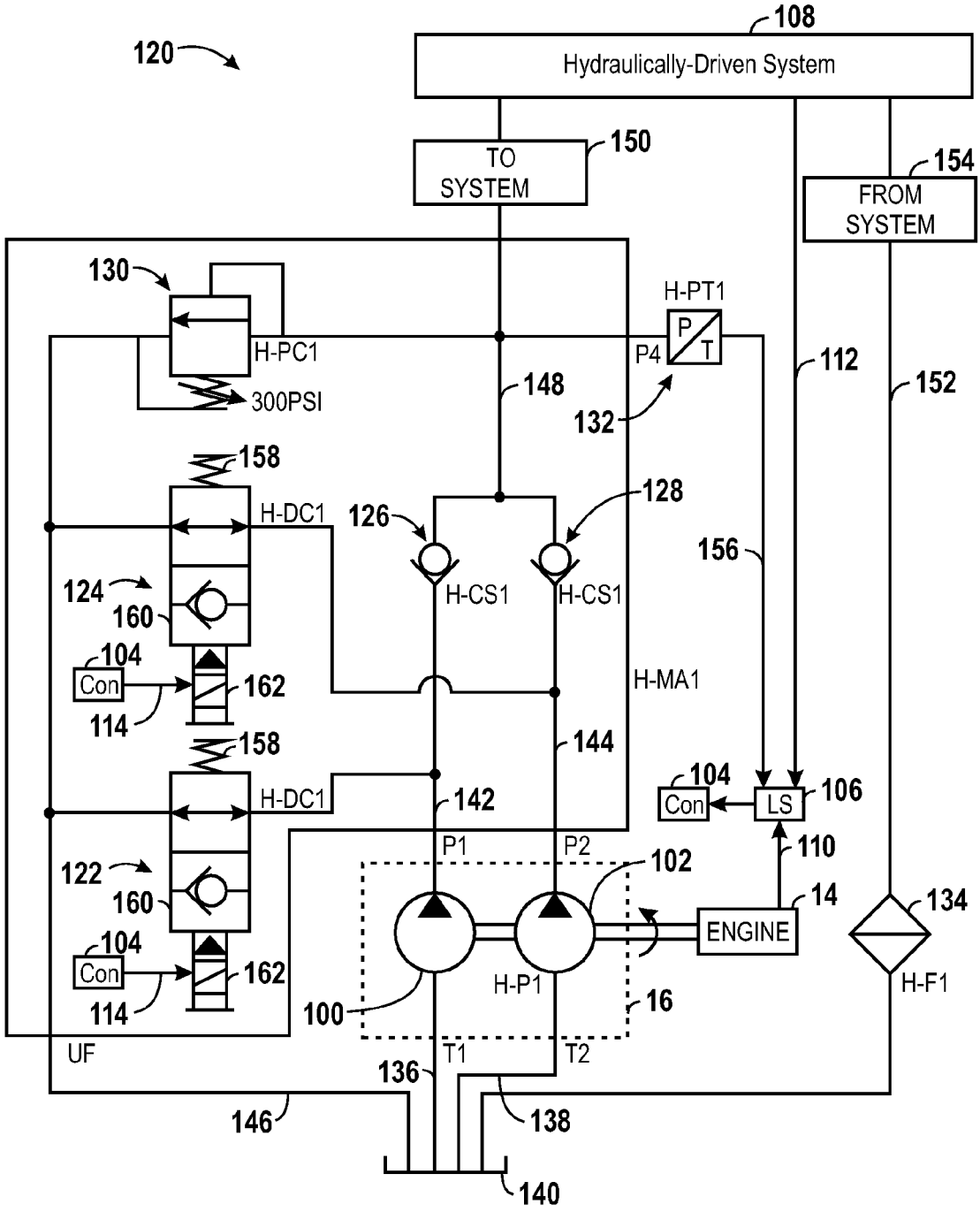
FIG. 5 is a diagram illustrating a tandem gear pump circuit with load sense in accordance with certain embodiments.

FIG. 5 is a diagram illustrating a tandem gear pump circuit 120 in accordance with certain embodiments. As illustrated in FIG. 5, the circuit 120 includes a tandem hydraulic pump system 16 (H-P1) with two pumps 100 and 102 being driven by a prime mover 14 (e.g., an internal combustion engine), two hydraulic directional control valves 122 and 124 (H-DC1), two hydraulic check valves 126 and 128 (H-CS1), a hydraulic pressure control valve 130 (H-PC1), a hydraulic pressure transducer 132 (H-PT1), and a hydraulic filter 134 (H-F1). The tandem pump system 16 has a tandem arrangement of pumps 100 and 102, e.g., parallel, series, or both. The circuit 120 has one or more suction lines 136 and 138 (T1 and T2) that receive fluid from a reservoir or tank 140, a pair of pressure lines 142 and 144 (P1 and P2) that deliver fluid to the valve assemblies 126 and 128 (H-CS1), an unload/relief line 146 (UF) that returns the fluid to the reservoir 140, and a pressure line 148 from the valve assemblies 126 and 128 to the hydraulically-driven system 108 (block 150). The circuit 120 also includes a return line 152 from the hydraulically-driven system 108, through the filter 134 (H-F1), and back to the reservoir 140 (block 154).

The tandem pump system 16 has a tandem arrangement of pumps 100 and 102, e.g., parallel, series, or both. As illustrated in FIG. 5, the two pumps 100 and 102 of the tandem pump system 16 are of different displacements. The different pump displacements result in 3 different flow rates, e.g., combined flowrate, flowrate of the larger pump, and flowrate of the smaller pump.

The controller 104 uses load sense 106 associated with the engine 14, the hydraulically-driven system 108, and/or the pressure transducer 132 (H-PT1). The load sense 106 is configured to provide an indication of the engine load, such that the controller 104 can adjust the tandem pump system 16 in a manner more closely matching (e.g., "power matching") the power availability of the engine 14 with the demanded hydraulic load. In the present discussion of FIG. 5, the controller 104 may control the utilization of the tandem pump system 16 based on the pressure transducer 132 without any load sense from the engine 14 and/or hydraulically-driven system 108. However, other embodiments may utilize load sense from any suitable source indicative of engine load.

In the illustrated embodiment, for example, the load sense 106 may include a signal 156 from the pressure transducer 132 (H-PT1), such that the controller 104 can determine when to operate the hydraulic directional control valves 122 and 124 (H-DC1). As appreciated, the valves 122 and 124 cooperate with check valves 126 and 128 to control the fluid flow, e.g., check valves 126 and 128 open when valves 122 and 124 close and vice versa. In particular, the controller 104 selectively enables or disables the hydraulic directional control valves 122 and 124 (H-DC1) to switch between a loaded pump configuration and an unloaded pump configuration between each pump 100 and 102 and either the hydraulically-driven system 108 or the reservoir 140. In other words, the hydraulic directional control valves 122 and 124 (H-DC1) either enable the fluid flow from the pumps 100 and 102 to pass through lines 142 and 144 on to the hydraulically-driven system 108, or the valves 122 and 124 return the fluid flow from the pumps 100 and 102 back to the reservoir 140. If the valves 122 and 124 enable the fluid flow to pass from the pumps 100 and 102 to the hydraulically-driven system 108, then the pumps 100 and 102 put a load on the engine 14. In contrast, if the valves 122 and 124 disable flow to the hydraulically-driven system 108 by returning the fluid flow from the pumps 100 and 102 back to the reservoir 140, then the pumps 100 and 102 do not put any load (or put a minimal load) on the engine 14. Thus, the controller 104 is configured to control these valves 122 and 124 to vary the hydraulic load in response to feedback from the load sense 106 (e.g., signal 156 from pressure transducer 132).

In certain embodiments, the circuit 120 may have several modes of operation, including a stand-by (i.e., no flow) state, a low flow state, a medium flow state, and a high flow state. For example, in the stand-by state, the controller 104 may de-energize or open both hydraulic directional control valves 122 and 124 (H-DC1) to unload the fluid flow to the reservoir 140, and thus, minimize or eliminate the load on the engine 14. For example, the valves 122 and 124 may be normally open valves, which include a spring 158, a valve member 160, and a solenoid or actuator 162. The spring 158 may bias the valve member 160 toward a normally open position, whereas the solenoid 162 may be energized to overcome the spring 158 and move the valve member 160 to a closed position.

If the tandem pump system 16 is operating and the pressure transducer 132 (H-PT1) indicates a low pressure to the controller 104, then the controller 104 may energize or close both valves 122 and 124 to enable fluid flow from both pumps 100 and 102 (P1 and P2), through check valves 126 and 128, and on to the hydraulically-driven system 108. In this configuration, the tandem pump system 16 may be described as a high flow state due to the combined operation of both pumps 100 and 102.

If the tandem pump system 16 is operating and the pressure transducer 132 (H-PT1) indicates a medium pressure to the controller 104, then the controller 104 may energize or close only one of the valves 122 and 124 to enable fluid flow from only one of the pumps 100 and 102 (e.g., higher flow rate pump) to the hydraulically-driven system 108. In this configuration, the tandem pump system 16 may be described as a medium flow state due to the limited operation of only one of the pumps 100 and 102 (e.g., only one pump with higher flow rate is providing fluid to the system 108). For example, if the pump 100 provides a lower flow rate than the pump 102, then the controller 104 may energize or close only the valve 124 associated with the pump 102 with the higher flow rate, thereby directing flow from the pump 102 through check valve 128 to the system 108. Simultaneously, the valve 122 connected to the pump 100 with lower flow rate is de-energized or opened such that the check valve 126 remains closed, thereby directing flow from the pump 100 to the reservoir 140.

If the tandem pump system 16 is operating and the pressure transducer 132 (H-PT1) indicates a high pressure to the controller 104, then the controller 104 may energize or close only one of the valves 122 and 124 to enable fluid flow from only one of the pumps 100 and 102 (e.g., lower flow rate pump) to the hydraulically-driven system 108. In this configuration, the tandem pump system 16 may be described as a low flow state due to the limited operation of only one of the pumps 100 and 102 (e.g., only one pump with lower flow rate is providing fluid to the system 108). For example, if the pump 100 provides a lower flow rate than the pump 102, then the controller 104 may energize or close only the valve 122 associated with the pump 100 with the lower flow rate, thereby directing flow from the pump 100 through the check valve 126 to the system 108. Simultaneously, the valve 124 connected to the pump 102 with higher flow rate is de-energized or opened such that the check valve 128 remains closed, thereby directing flow from the pump 102 to the reservoir 140.

In this manner, the controller 104 reduces power consumption on the engine 14 by unloading the fluid flow of one or more pumps 100 and 102, as the pumps 100 and 102 are unloaded at relatively low pressure. In certain embodiments, the circuit 120 may vary the power availability conditions via different pressure set points as indicated by the signal 156 from the pressure transducer 132. For example, the controller 104 may have a first pressure set point associated with the stand-by (e.g., no flow; valves 122 and 124 open) state, a second pressure set point associated with the low flow state (e.g., valve 122 closed; valve 124 open), a third pressure set point associated with the medium flow state (e.g., valve 122 open; valve 124 closed), and a fourth pressure set point associated with the high flow state (e.g., valves 122 and 124 closed). The controller 104 may trigger the opening or closing of the valves 122 and 124 in response to the signal 156 from the pressure transducer 132 and a comparison of the hydraulic pressure versus these pressure set points. Thus, in response to the pressure in the system (e.g., via signal 156), the controller 104 may increase or decrease the flow rate and load on the engine 14. These pressure set points may be described as load conditions associated with the engine 14, as the pressures change the load on the engine 14.

Likewise, similar set points may be used by the controller 104 based on other feedback from load sense 106, e.g., load conditions 110 directly from the engine 14 and/or load conditions 112 from the hydraulically-driven system 108. For example, set points may be based on different engine exhaust temperatures, different fuel injection flow rates or throttle positions, different engine power or torque levels, different engine RPMs, and so forth. By further example, set points may be based on different hydraulic pressures, fluid flow rates, or the like, in the hydraulically-driven system 108. Thus, a variety of set points may be used to engage and disengage flow from the pumps 100 and 102 to the hydraulically-driven system 108.

In the illustrated embodiment, the circuit 120 has constant displacement pumps 100 and 102 in the tandem pump system 16. In this configuration, the circuit 120 may be configured as an open-center system. In some embodiments, the circuit 120 may use variable displacement pumps 100 and 102 in the tandem pump system 16. In this latter configuration, the circuit 120 may be configured as a closed-center system. However, any suitable configuration may be used with the load sense techniques described above.

The disclosed embodiments may provide several advantages. For example, the disclosed embodiments allow the use of smaller prime mover 14 (e.g., an internal combustion engine) or the addition of other power consuming functions by controlling hydraulic power consumption. With a smaller engine 14, fuel efficiency and therefore fuel savings are inherent. The disclosed embodiments also may provide control of the hydraulic directional control valves 122 and 124 (H-DC1) by use of a pressure signal 156 from the hydraulic pressure transducer 132 (H-PT1) to allow changes in shift points based on power available. The disclosed embodiments also may provide power consumption control that overrides user demands when used with power feedback and control scheme.

Any number of pumps may be used to provide finer control, e.g., more step points, via the pumps being used alone or in various combinations with one another. In certain embodiments, if only two flowrates are desired, then the switching mechanism may be provided within the pump assembly. Furthermore, in certain embodiments, the control scheme may use manual or automated actuation instead of electronic control of the hydraulic directional control valves.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A service pack, comprising:

an engine; and a tandem pump system coupled to the engine, wherein the tandem pump system comprises a first fluid pump and a second fluid pump in tandem with one another; and a controller configured to enable the first fluid pump at a first load condition associated with the engine, the second fluid pump at a second load condition associated with the engine, and both the first and second fluid pumps at a third load condition associated with the engine, wherein the first, second and third load conditions are different.

2. The service pack of claim 1, wherein the engine comprises a spark ignition engine or a compression ignition engine.

3. The service pack of claim 1, wherein the first and second fluid pumps each have constant displacements that are equal to one another.

4. The service pack of claim 1, wherein the second fluid pump has a greater displacement than the first fluid pump.

5. The service pack of claim 1, wherein the first fluid pump, the second fluid pump, or both, comprises a variable displacement pump.

6. The service pack of claim 1, wherein the first fluid pump is configured to pump hydraulic fluid to a hydraulically-driven system when a first hydraulic pressure exists in the system, the second fluid pump is configured to pump hydraulic fluid to the hydraulically-driven system when a second hydraulic pressure exists in the system, and both the first and second fluid pumps are configured to pump hydraulic fluid to the hydraulically-driven system when a third hydraulic pressure exists in the system.

7. The service pack of claim 6, wherein the second fluid pump has a greater displacement than the first fluid pump, the first hydraulic pressure is higher than the second and third hydraulic pressures, and the second hydraulic pressure is higher than the third hydraulic pressure.

8. The service pack of claim 1, wherein the controller is configured to prevent a possible overload condition of the engine by selectively engaging only the first fluid pump, or only the second fluid pump, or both the first and second fluid pumps depending on a load on the engine.

9. The service pack of claim 1, comprising an electrical generator driven by the engine.

10. The service pack of claim 1, comprising an air compressor driven by the engine.

11. The service pack of claim 1, comprising an electrical generator and an air compressor driven by the engine.

12. The service pack of claim 1, wherein the controller is configured to monitor at least one parameter relating to a fuel injection quantity, an exhaust from the engine, or a combination thereof, to determine a load associated with the engine, wherein the first, second, and third load conditions are determined based on the load.

13. The service pack of claim 1, wherein the controller is configured to disable at least one of the first and second fluid pumps to prevent or eliminate an overload condition on the engine, and the controller is configured to enable at least one of the first and second fluid pumps to prevent or eliminate an underload condition on the engine.

14. A power control system, comprising:

a controller configured to enable a first fluid pump without a second fluid pump at a first load condition associated with an engine, the controller is configured to enable the second fluid pump without the first fluid pump at a second load condition associated with the engine, and the controller is configured to enable both the first and second fluid pumps at a third load condition associated with the engine, wherein the first and second fluid pumps are arranged in tandem with one another and are driven by the engine, and wherein the first, second, and third load conditions are different.

15. The power control system of claim 14, wherein the first and second fluid pumps each have constant displacements and different displacements than one another.

16. The power control system of claim 14, wherein the first fluid pump, the second fluid pump, or both, comprises a variable displacement pump.

17. The power control system of claim 14, wherein the first load condition comprises a first hydraulic pressure in a hydraulically-driven system, the second load condition comprises a second hydraulic pressure in the hydraulically-driven system, the third load condition comprises a third hydraulic pressure in the hydraulically-driven system, the first hydraulic pressure is higher than the second and third hydraulic pressures, and the second hydraulic pressure is higher than the third hydraulic pressure.

18. The power control system of claim 14, wherein the controller is configured to prevent a possible overload condition of the engine by selectively engaging only the first fluid pump, or only the second fluid pump, or both the first and second fluid pumps depending on the load on the engine.

19. The power control system of claim 14, wherein the controller is configured to selectively enable and disable the first and second fluid pumps, alone or in combination, to help reduce a gap between an available power by the engine and a demanded hydraulic load utilizing power from the engine.

20. A method of managing power of an engine-driven system, comprising:

sensing a load associated with an engine; and selectively pumping hydraulic fluid into a hydraulic system from a first fluid pump without a second fluid pump based on a first level of the load, the second fluid pump without the first fluid pump based on a second level of the load, and both the first and second fluid pumps based on a third level of the load, wherein the first, second, and third levels of the load are different.

21. The method of claim 20, wherein sensing the load comprises identifying an overload condition or a near overload condition of the engine, and selectively pumping hydraulic fluid comprises reducing the load to eliminate the overload condition or near overload condition.

22. The method of claim 20, wherein sensing the load comprises monitoring hydraulic pressure in the hydraulic system as an indication of the load associated with the engine.

23. The method of claim 20, wherein selectively pumping comprises pumping hydraulic fluid from the first fluid pump without the second fluid pump at a first hydraulic pressure in the hydraulic system, pumping hydraulic fluid from the second fluid pump without the first fluid pump at a second hydraulic pressure in the hydraulic system, and pumping hydraulic fluid from the first and second fluid pumps at a third hydraulic pressure in the hydraulic system, wherein the first hydraulic pressure is higher than the second and third hydraulic pressures, and the second hydraulic pressure is higher than the third hydraulic pressure.

* * * * *